US006513964B1

(12) United States Patent
Himmelright et al.

(10) Patent No.: US 6,513,964 B1
(45) Date of Patent: Feb. 4, 2003

(54) MASS BALANCE PROPORTIONER

(75) Inventors: James W. Himmelright, Medina, OH (US); Joseph D. Rose, Medina, OH (US)

(73) Assignee: Dylon Industries, Inc., Cleveland, OH (US)

( * ) Notice: Subject to any disclaimer, the term of this patent is extended or adjusted under 35 U.S.C. 154(b) by 31 days.

(21) Appl. No.: 09/922,383

(22) Filed: Aug. 4, 2001

(51) Int. Cl.[7] ..... B01F 15/02
(52) U.S. Cl. ..... 366/141; 366/152.6
(58) Field of Search ..... 366/141, 152.6, 366/154.1, 155.1, 152.1, 160.1, 279

(56) References Cited

U.S. PATENT DOCUMENTS 3,580,072 A * 5/1971 Cox et al. ..... 73/861.03
3,608,869 A * 9/1971 Woodle ..... 366/159.1
3,669,900 A * 6/1972 Cummings ..... 366/279
4,048,854 A * 9/1977 Herzl ..... 73/861.02
4,494,209 A * 1/1985 Agarwal ..... 700/265
5,105,767 A * 4/1992 Gordon et al. ..... 119/57.92
5,314,703 A * 5/1994 Gibney et al. ..... 426/231
5,340,210 A * 8/1994 Patel et al. ..... 366/141
5,558,435 A * 9/1996 Marjo ..... 366/141
5,580,168 A * 12/1996 Alireza et al. ..... 366/153.1
5,899,563 A * 5/1999 Karras ..... 366/152.3
6,120,175 A * 9/2000 Tewell ..... 366/141
6,130,262 A * 10/2000 Suzuki et al. ..... 366/150.1

* cited by examiner

*Primary Examiner*—Tony G. Soohoo

(57) ABSTRACT

An apparatus for mixing and diluting a concentrated liquid lubricant and a dilution material to form a diluted lubricant solution and more particularly a mass balance proportioner for weighing and mixing a concentrated lubricant and a dilution material to form a diluted lubricant having a predetermined dilution ratio based upon weight of concentrated lubricant to weight of dilution material.

17 Claims, 2 Drawing Sheets

MASS BALANCE PROPORTIONER

RELATED APPLICATIONS

None.

1. Description—Technical Field

The present invention relates to apparatus for mixing and diluting a concentrated liquid lubricant and a dilution material to form a diluted lubricant solution and more particularly to a mass balance proportioner for weighing and mixing a concentrated lubricant and a dilution material to form a diluted lubricant having a predetermined dilution ratio based upon weight of concentrated lubricant to weight of dilution material. The mass balance proportioner includes a mixing tank for receiving the concentrated lubricant and the dilution material, a scale for weighing the concentrated lubricant in the mixing tank and the dilution material in the mixing tank to establish a mixture of diluted lubricant which is predetermined based upon weight of concentrated lubricant to weight of dilution material. A mixer is provided to mix the concentrated lubricant and dilution material in the mixing tank to form a substantially homogeneous solution of diluted lubricant and an outlet is provided from the mixing tank. A storage tank receives the homogeneous solution of mixed concentrated lubricant and dilution material from the mixing tank and holds the mixed solution for use. A second mixer is provided for mixing the solution in the storage tank to maintain a substantially homogeneous solution of lubricant and dilution material.

2. Background of the Invention

Volumetric proportioners are well known for mixing a number of materials such as a lubricant and a dilution material based on the sensed volume of the dilution material and the sensed volume of lubricant. However, volumetric proportioners are not accurate in that they are unable to compensate for variables in the make up of the lubricant, oil, or other product that is being diluted. Such variables include density, viscosity and head pressures.

Density fluctuations are caused by temperature variations which can cause the density of the material to be mixed to increase or decrease and thus create either high or low dilution rates in volumetric proportioners. Density fluctuations are also caused by foam generated by the centrifugal or gear pumps typically used in volumetric proportioners. The foam lowers the density of lubricant which is being pumped and thus drops the amount of lubricant in the final dilution solution.

When a lubricant is pumped, the centrifugal and gear pumps typically used in volumetric proportioners are very viscosity sensitive, but the pumps do not compensate for the viscosity variances when viscosity variances occur. Thus, viscosity variances create inaccuracies in volumetric proportioners which occur based upon lubricant temperature and normal fluctuations in the base oils disposed in the lubricant. In addition, centrifugal and gear pumps are sensitive to head pressure and if the lubricant is being supplied from an intermediate bulk container, as the level of fluid in the container decreases, the efficiency of the pump will decrease especially with high density or concentrated lubricants causing further inaccuracies in volumetric proportioners.

The present invention overcomes the problems associated with the prior art by providing a mass balance proportioner which weighs both the concentrated lubricant and the dilution material. This eliminates any errors in dilution that may be caused by changes in density, viscosity or head pressure and ensures that any final dilution will remain constant based upon weight of lubricant to weight of dilution material. This provides a substantial improvement over volumetric proportioners which form a dilution based on gallon of lubricant to gallon of dilution material and which are sensitive to changes in density, viscosity and head pressures.

SUMMARY OF INVENTION

The present invention provides a simple, low cost mass balance proportioner for weighing and mixing a concentrated lubricant and a dilution material to form a diluted lubricant which has a predetermined dilution ratio based upon weight of concentrated lubricant to weight of dilution material and which maintains accuracy even when changes in density, viscosity or head pressure occur.

The present invention further provides a new and improved mass balance proportioner for weighing and mixing a concentrated lubricant and a dilution material to form a diluted lubricant having a predetermined dilution ratio based upon weight of concentrated lubricant to weight of dilution material including a supply of concentrated lubricant, a supply of dilution material, a mixing tank for receiving the concentrated lubricant and the dilution material, a scale for weighing the concentrated lubricant in the mixing tank and the dilution material in the mixing tank to establish a predetermined mixture of diluted lubricant in said mixing tank which is predetermined and based upon weight of concentrated lubricant to weight of dilution material. A mixer for mixing the concentrated lubricant and dilution material in the mixing tank is provided to form a substantially homogeneous solution of diluted lubricant. An outlet is located in the mixing tank and a storage tank is provided for receiving and storing the mixed homogeneous solution of diluted lubricant. A second mixer is located in the storage tank for mixing the diluted lubricant in the storage tank to maintain a substantially homogenous mixture of diluted lubricant and an outlet is provided from the storage tank for directing the homogeneous solution of diluted lubricant to a use location.

Still another provision of the present invention is to provide an apparatus for mixing a concentrated lubricant and a dilution material by weight comprising a first container, a first inlet for directing a supply of concentrated lubricant to the first container, a second inlet for directing a supply of dilution material to the first container, a scale for weighing the dilution material in the first container and for weighing the concentrated lubricant in the first container to establish a diluted lubricant solution in the first container which is based upon a preset ratio of weight of concentrated lubricant to weight of dilution material, a first mixer for mixing the concentrated lubricant and the dilution material in said first container to create a substantially homogeneous solution of diluted lubricant and an outlet in the first container for directing the mixed solution of diluted lubricant from the first container, a second container for receiving the substantially homogeneous solution of diluted lubricant for storing the solution of diluted lubricant for use, a second mixer for mixing the diluted lubricant in the second container to maintain a substantially homogeneous solution of lubricant and dilution material and an outlet from the second container for directing the solution of diluted lubricant to a use location.

DESCRIPTION OF THE PREFERRED EMBODIMENT

Figure 1:
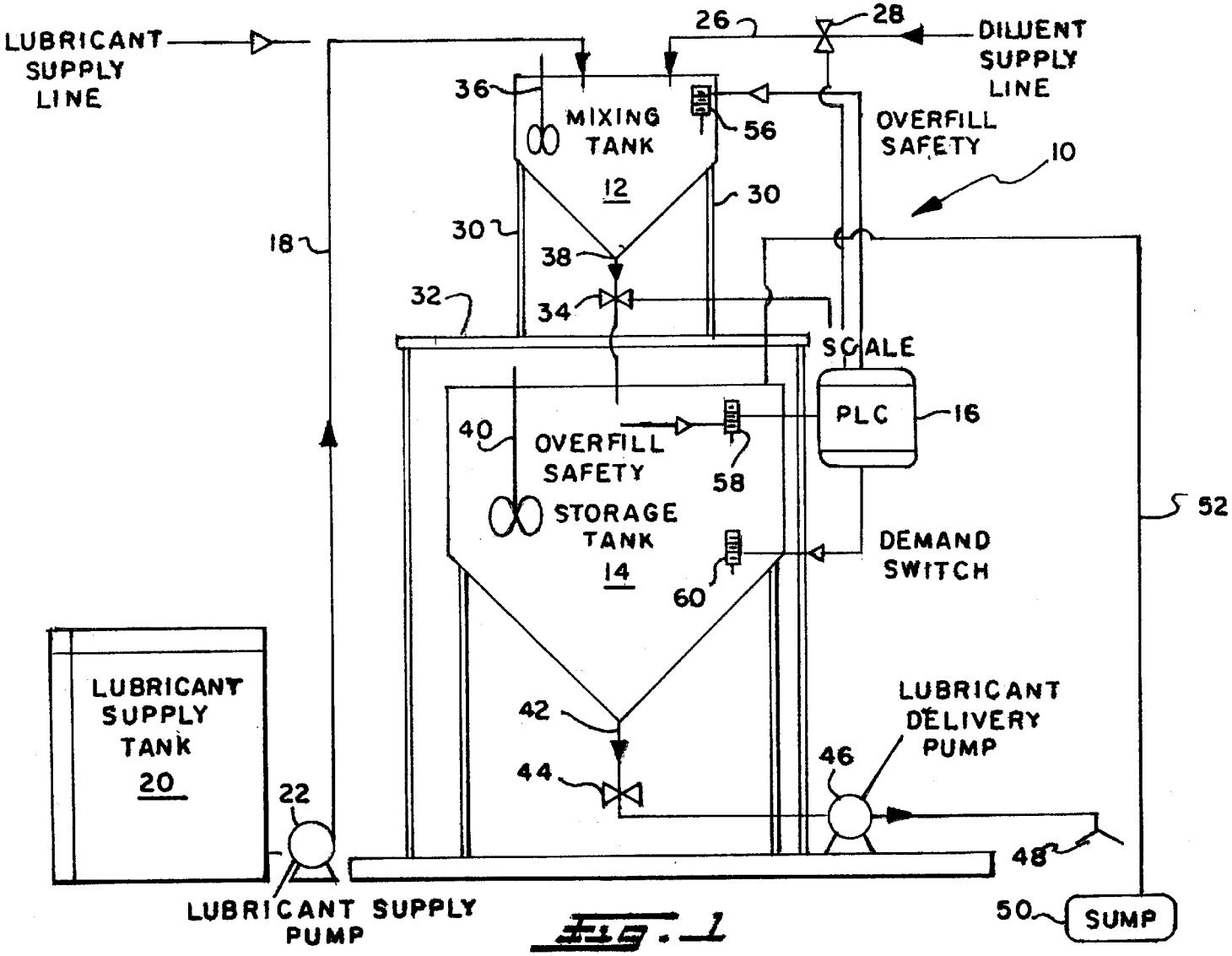
FIG. 1 is a schematic view of the mass balance proportioner of the present invention schematically illustrating the mixing tank, the storage tank and the control.

Referring to the figures and more particularly to FIG. 1, a mass balance proportioner 10 constructed in accordance with the present invention is illustrated. The mass balance proportioner 10 includes a first container or mixing tank 12 and a second container or storage tank 14. A conduit 18 is provided to supply the mixing tank with a source of concentrated lubricant. The conduit 18 is connected to a lubricant supply tank 20 which is adapted to receive a supply of concentrated lubricant to be diluted. A lubricant supply pump 22 is located in the conduit 18 and operates, when energized, to pump concentrated lubricant from the lubricant supply tank 20 through conduit 18 to the mixing tank 12. A flow sensor 19 is disposed in conduit 18 to sense the flow of concentrated lubricant therethrough.

A second conduit 26 is provided for supplying a supply of dilutent material to the mixing tank 12. In the preferred embodiment the dilutent is water and the conduit 26 is connected to a water line. A valve 28 is disposed in the conduit 26 to control the flow of dilutent material through the conduit 26 to tank 12 and a flow sensor 27 is disposed in conduit 26 to sense the flow of dilutent therethrough.

The mixing tank 12 includes a plurality of legs 30 which support the mixing tank 12. The legs 30 rest on the upper surface of a scale 32 which registers the weight of the mixing tank 12 and the contents thereof. The scale can be "zeroed" to eliminate the weight of the mixing tank 12 so that the scale only registers the weight of the contents of the mixing tank 12. The scale establishes an output signal which is indicative of the weight of the material in the mixing tank 12. The output signal from the scale is directed to a control 16 which in the preferred embodiment is a programmable logic controller such as model DR9100, manufactured by I.C.S., located at California but other controls such as personal computer, microprocessors or large computers could be used.

In the preferred embodiment of the invention, the dilutent material is initially supplied through the conduit 26 and the scale 32 registers the weight of the dilutent in tank 12 and establish a first output signal to control 16 indicative of the weight of dilutent in tank 12. The programmable logic controller 16 is programmed to provide for a predetermined weight of dilutent in the mixing tank 12. When the predetermined weight of dilutent is provided in the mixing tank 12, the programmable logic controller 16 closes the valve 28 to shut down the supply of dilutent to the mixing tank and then energizes lubricant supply pump 22 to supply a predetermined amount, by weight, of concentrated lubricant from the lubricant supply tank 20 to the mixing tank 12. When dilutent or concentrated lubricant is supplied to mixing tank 12, signals from flow sensor 19 and 27 are provided to control 16 to signal the flow of lubricant and dilutent to the mixing tank 16. In the event the flow ceases one of the flow sensors 19, 27 will sense the lack of flow and send a signal to the control to shut down the system. In addition, if the valve 28 fails to close sensor 27 will send a signal to control 16 to shut down the system. When scale 32 senses that a predetermined weight of lubricant has been supplied to the mixing tank 12, scale 32 establishes a second output signal to control 16 indicative of the weight and the programmable logic controller 16 will de-energize lubricant supply pump 22 to stop the flow of concentrated lubricant to tank 12 to thereby establishing a predetermined mixture by weight of concentrated lubricant and dilutent in the mixing tank 12.

A mixer 36 is located in mixing tank 12 and mixes the material in mixing tank 12. The mixer 36 is energized by the control 16 when lubricant supply pump 22 is deenergized by control 16 after the correct weight of lubricant and dilution material has been supplied into the mixing tank. In the preferred embodiment, the mixer 36 is an air operated mixer which mixes the concentrated lubricant and water to keep the solids in suspension and form a substantially homogeneous solution of lubricant and water in the mixing tank 12. In a preferred embodiment of the invention, the mixer 36 is energized by control 16 after the correct weight of concentrated lubricant and dilution material is received in tank 12 to prevent forces from the mixer 36 and the material in tank 12 from interfering with the operation of scale 32. The mixing tank 12 includes an outlet 38 in which is located a valve 34 for directing the mixed homogeneous solution of diluted lubricant from the mixing tank 12.

The storage tank 14 is located below mixing tank 12 to allow flow of fluid from the mixing tank 12 through the outlet 38 into the storage tank 14 by gravity thus, eliminating the requirement for an additional pump. The storage tank 14 receives the mixed homogeneous solution of lubricant and dilution material and includes a mixer 40 which continuously mixes the lubricant and dilutent in storage tank 14 to ensure a substantially homogeneous solution of diluted lubricant. The storage tank 14 includes an outlet 42 having a valve 44 disposed therein for directing the mixed homogeneous solution of diluted lubricant from the storage tank 14 to a use site schematically illustrated at 48. The valve 44 is preferably manually controlled and a lubricant delivery pump 46 can be provided to pump the solution of diluted lubricant to the use site 48. A sump 50 is preferably provided at the use site to collect any excess solution of diluted lubricant and return same for reuse to storage tank 14. A sump return conduit 52 connects the sump 50 with the storage tank 14 to provide for the return of excess diluted lubricant from the sump 50 to the storage tank 14.

Mixing tank 12 includes a liquid level sensor 56 which is disposed thereon for sensing the liquid level in the mixing tank 12. The liquid level sensor 56 is designed to send a signal to the control 16 when the level of liquid in mixing tank 12 reaches a predetermined maximum level. When the maximum liquid level is sensed, the liquid level sensor 56 will send a signal to the programmable logic controller 16 which will cause programmable logic controller 26 to close valve 28 and de-energize lubricant supply pump 22 to prevent overflowing of the mixing tank 12.

The storage tank 14 includes a liquid level sensor 58 which senses the liquid level in the storage tank 14 and functions in a manner similar to the liquid level sensor 56. Liquid level sensor 58 is set to direct a signal to control 16 when the level of liquid in storage tank 14 reaches a predetermined maximum level. When the maximum liquid level is sensed, liquid level sensor 58 sends a signal to the controller 16 to cause controller 16 to close valve 34 to prevent further liquid from entering storage tank 14 from the mixing tank 12.

A further liquid level sensor 60 is disposed on storage tank 14 for sensing liquid level in storage tank 14. The liquid level sensor 60 is a minimum or demand level sensor which when activated sends a signal to the control 16 to indicate to the control 16 that additional diluted lubricant should be provided into the storage tank 14 from mixing tank 12. When the minimum level is sensed in storage tank 14 by the level sensor 60, the level sensor 60 will send a signal to the control 16 which will cause control 16 to open valve 34 to dump the diluted lubricant in the mixing tank 12 into the storage tank 14.

Figure 3:
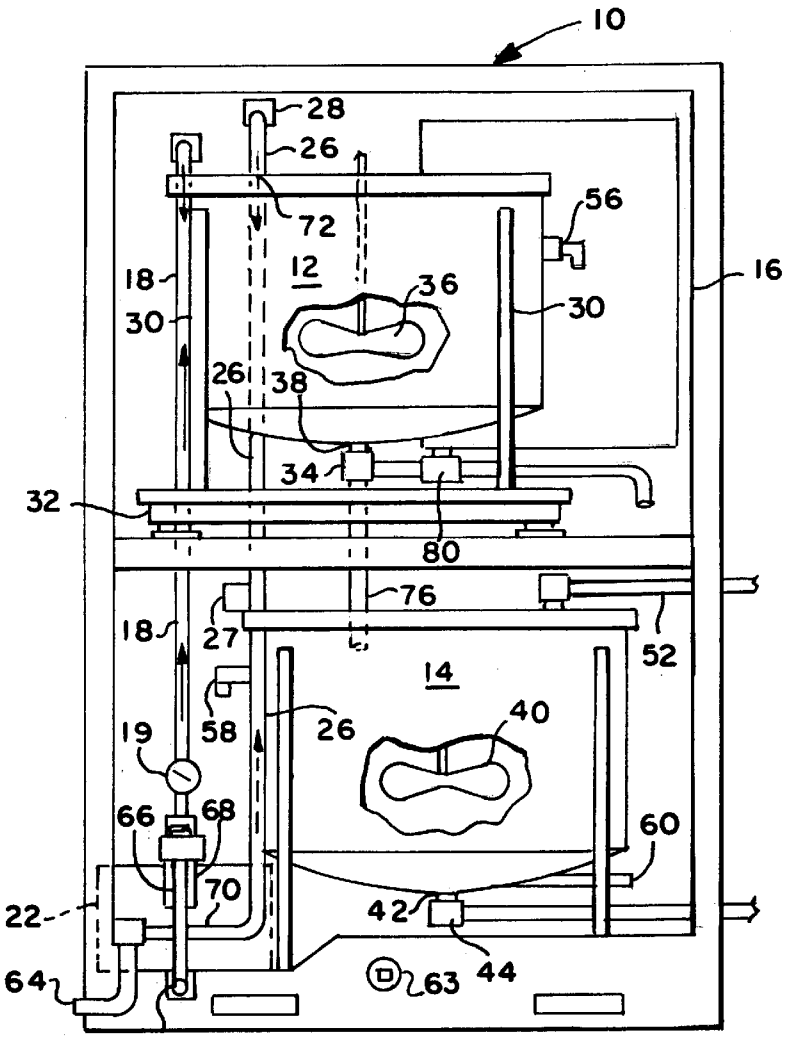
FIG. 3 is a partially fragmented back view of the mass balance proportioner illustrated in FIG. 2 take approximately along the line 3—3 of FIG. 2.
Figure 2:
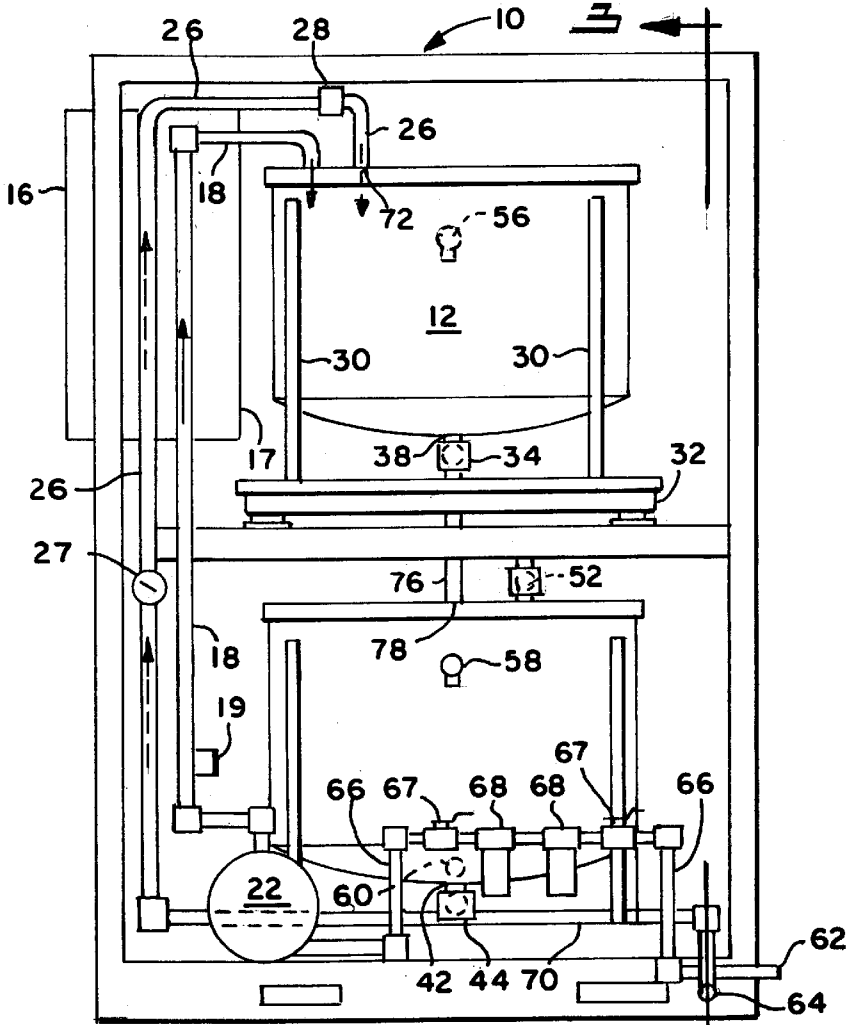
FIG. 2 is a side view of an embodiment of the present invention illustrating the mixing tank and the storage tank disposed within a storage cabinet.

Referring to FIGS. 2 and 3, an embodiment of the mass balance proportioner 10 is illustrated. Identical numerals will be utilized to denote the parts described with respect to FIG. 1. The mass balance proportioner 10 is located within a cabinet 60 which also serves as a containment in the event that any lubricant or dilutent spills or leaks. A drain plug 63 can be provided in the back of the cabinet for removing any fluid which has leaked into the cabinet 60.

The cabinet 60 includes an inlet 62 through which lubricant is supplied from a source of lubricant such as a lubricant supply tank 20 and an inlet 64 which, in the preferred embodiment, is a water inlet, but which could serve as an inlet for any other dilutent material such as oil. The lubricant to be diluted is supplied to the system through the lubricant inlet 62 via a conduit 66. A set of strainers 68 can be disposed in line 66 prior to pump 22 to prevent particles greater than a particular size flowing through the system. The strainers can be furnished with whatever mesh filter basket is deemed necessary, but in the preferred embodiment the standard filter is a U.S. 20 mesh. A pair of manual shut off valves 67 are located in conduit 66 on the opposite sides of strainers 68 to shut off flow through conduit 66 to allow the strainers 68 to be replaced and cleaned.

The programmable logic controller 16 is disposed within enclosure 17 located on the side wall of the cabinet 60. The enclosure 17 is preferably pressurized to eliminate intrusion of foreign matter therein. The programmable logic controller 16 is programmed for the desired dilution ratio. The dilution material, which in the preferred embodiment is water is supplied through the inlet 64 through the conduit 70 to the conduit 26 which includes an outlet 72 disposed within the mixing tank 12. Control valve 28 is located in conduit 26 adjacent outlet 72 and flow sensor 27 is located in conduit 26 to sense the flow of dilutent. The mixing tank 12 is mounted on scale 32 via legs 30. The dilution material, preferably water, is first supplied to the upper mixing tank 12 and when the appropriate weight is in the tank 12 the controller 16 closes valve 28. After valve 28 is closed, the controller 16 will activate lubricant pump 22, which in the preferred embodiment is a double diaphragm pump to pump concentrated lubricant to mixing tank 12. When the appropriate weight of lubricant has been pumped into the mixing tank 12, the control 16 shuts down the pump 22 and activates the air operated mixer 36 disposed in mixing tank 12. A liquid level sensor 56 which in the preferred embodiment is a high level safety switch is disposed on tank 12. In the event of a malfunction of the scale 32 and the liquid level raises in tank 12 to a maximum high liquid level, the safety switch 56 shuts down the system to avoid overflowing tank 12.

The length of time to make a batch of diluted lubricant is dependent upon the flow rate of the dilution material and flow rate of the double diaphragm pump 22 plus the length of the mixing time to ensure a homogeneous solution in the mixing tank 12. These can be varied using the control 16 to the point that a batch of diluted lubricant can be made in approximately seven minutes in a mixing tank having a capacity of approximately 240 pounds. This translates to a yield of approximately 1900 pounds of diluted lubricant per hour.

The bottom or storage tank 14 is located below mixing tank 12. Mixing tank 12 includes an outlet 38 which is connected to the conduit 76 which includes inlet 78 which directs fluid into the storage tank 14. A manual valve 80 can be provided for manually dumping a mixed lubricant from the mixing tank 12 if it is desired to mix a special dilution job that is not normally run from the system. The manual discharge system including valve 80 allows the dilution ratio to be changed on the controller 16 and a thirty gallon batch of diluted lubricant produced. The mixing tank is then emptied through the manual valve 80 into a transport container, not illustrated, which is used to transport the diluted lubricant to a use location. The controller 16 is reset to the original dilution ratio and the system returns to automatic operation uninterrupted.

When valve 34 is opened, the mixing tank 12 drains via gravity into the storage tank 14. As soon as the scale 32 registers zero after the dump valve 34 is actuated, the dump valve 34 will close and a new batch of lubricant will be started in the mixing tank 12 by control 16. The mixer 40 is continuously activated in the storage tank 14 to ensure that the diluted lubricant remains a homogeneous solution. The bottom or storage tank 14 is equipped with a low level sensor 60 which senses the level of fluid in the storage tank 14 and when the level drops to a predetermined low level a signal is sent from the sensor 60 to the control 16 and the control opens the dump valve 34 on the bottom of the mixing tank 12 and the diluted lubricant drops from the mixing tank 12 to the storage tank 14. The storage tank has air operated mixer 40 that runs continuously as long as diluted lubricant is in tank 14. The storage tank also has a high level liquid sensor which is a high level liquid safety switch 58. In the event that the dump valve 34 on the mixing tank 12 or the control 16 malfunctions and allows a batch of diluted lubricant to drop too soon from the mixing tank 12, the safety switch 58 will sense that the maximum level of fluid in tank 14 has been reached and will send a signal to the control 16 to cause the system to shut down and close valve 34.

In the preferred embodiment, the control 16 can be interfaced with a customers control or data gatherings system or can be used as a stand alone system. As a stand alone system the programmable logic control 16 can have unlimited dilution rate settings, can store totalization of lubricant use during any given period, totalization of dilution material used during any given period, calculation of exact dilution ratio by weight during any given period and usage per part or time period.

The following is an example of usage of the present invention in the forging industry on a forging press. The concentrated lubricant used is a product identified as FW-3243 manufactured and available from Dylon Industries Inc. in Cleveland, Ohio and the dilution ratio is approximately seven parts by weight water to one part by weight concentrated lubricant. A seven to one ratio by weight is entered into the programmable logic controller 16. The water supply valve 28 is actuated by the PLC and the water begins filling the mixing tank 12. When the scale 32 senses 240 pounds of water in the tank, a signal from the control 16 will shut off the water supply valve 28 and activate the lubricant supply pump 22. When the scale 32 senses that thirty-four pounds of FW-3243 concentrated lubricant has been pumped into the mixing tank 12 the control 16 de-energizes the lubricant supply pump 22 and energizes the mixer 36 for two minutes to form a homogeneous solution of diluted lubricant in tank 12 which is transferred to storage tank 14 for use. When the reading on scale 32 reaches zero, valve 34 is shut and the system begins to make another batch of lubricant in tank 12. When the level of diluted lubricant in the storage tank 14 drops below the minimum low level as sensed by the liquid level switch 60, a signal from the control 16 opens the valve 34 to dump the solution of diluted lubricant in the mixing tank 12 into the storage tank 14. While the example has been illustrated using a particular concentrated lubricant, other types of lubricants such as die lubricants, forging lubricants, and extrusion lubricants could be diluted without departing from the scope of the present invention.

From the foregoing, it should be apparent that a new and improved mass balance proportioner 10 for weighing and mixing a concentrated lubricant and a dilution material to form a diluted lubricant having a predetermined dilution ratio based upon weight of concentrated lubricant to weight of dilution material has been provided. The mass balance proportioner 10 includes a lubricant supply tank 20 for providing a supply of concentrated lubricant and a water supply line 26 for providing a supply of a dilution material. A mixing tank 12 is provided for receiving the concentrated lubricant and the dilution material and a scale 32 is provided for weighing the concentrated lubricant in the mixing tank 12 and the dilution material in the mixing tank 12 to establish a mixture of diluted lubricant in the mixing tank 12 which is predetermined and based upon weight of concentrated lubricant to weight of dilution material. The mixing tank 12 includes a mixer 36 for mixing the concentrated lubricant and dilution material in the mixing tank 12 to from a homogeneous solution of diluted lubricant. An outlet 38 is provided in the mixing tank 12 and a storage tank 14 is disposed beneath the mixing tank for receiving from the outlet of the mixing tank, the mixed solution of diluted lubricant. A second mixer 40 is located in the storage tank 14 to maintain a substantially homogeneous mixture of lubricant and dilution material in the storage tank. An outlet 42 is provided from the storage tank 14 for directing the diluted lubricant to a use location 48.

What we claims is:

1. A mass balance proportioner for weighing and mixing a concentrated lubricant and a dilution material to form a diluted lubricant having a predetermined dilution ratio based upon weight of concentrated lubricant to weight of dilution material comprising a supply of concentrated lubricant, a supply of dilution material, a mixing tank for receiving said concentrated lubricant and said dilution material, a scale for weighing said concentrated lubricant in said mixing tank and said dilution material in said mixing tank to establish a mixture of diluted lubricant in said mixing tank which is predetermined and based upon weight of concentrated lubricant to weight of dilution material, a mixer for mixing the concentrated lubricant and dilution material in said mixing tank to form a homogenous solution of diluted lubricant, an outlet in said mixing tank, a storage tank for receiving from said outlet of said mixing tank and storing said mixed solution of diluted lubricant, a second mixer for mixing the solution of diluted lubricant in said storage tank to maintain a substantially homogeneous mixture of lubricant and dilution material and an outlet from said storage tank for directing the solution of diluted lubricant to a use location.

2. A mass balance proportioner for weighing and mixing a concentrated lubricant and a dilution material to form a diluted lubricant having a predetermined dilution ratio based upon weight of concentrated lubricant to weight of dilution material as defined in claim 1, further including a sump located at the use location for collecting excess solution of diluted lubricant and a return conduit for directing said excess solution of diluted lubricant from said sump to said storage container for remixing and reuse.

3. A mass balance proportioner for weighing and mixing a concentrated lubricant and a dilution material to form a diluted lubricant having a predetermined dilution ratio based upon weight of concentrated lubricant to weight of dilution material as defined in claim 1 wherein said scale establishes an output signal indicative of the weight of the material in said mixing tank and further including a control for controlling the flow of concentrated lubricant and dilution material to said mixing tank and the predetermined dilution ratio in said mixing tank which is predetermined based upon weight of concentrated lubricant to weight of dilution material, said control receiving said output signal from said scale and sensing the weight of said concentrated lubricant and the weight of said dilutent material in said mixing tank, a first valve for controlling the flow of said dilution material to said mixing tank, a pump for pumping said concentrated lubricant to said mixing tank from said supply of concentrated lubricant, said control being connected to said first valve and said pump for controlling the flow of said concentrated lubricant and said dilutent material to said mixing tank in response to said output signal from said scale to establish a solution of concentrated lubricant and dilutent material in said mixing tank which is a predetermined ratio of weight of concentrated lubricant to weight of dilution material.

4. A mass balance proportioner for weighing and mixing a concentrated lubricant and a dilution material to form a diluted lubricant having a dilution ratio based upon weight of concentrated lubricant to weight of dilution material as defined in claim 3, further including a second valve located in said outlet of said mixing tank for controlling the flow of said solution of diluted lubricant in said mixing tank into said storage tank and a third valve located in said outlet of said storage tank for controlling the flow of said solution of diluted lubricant material from said storage tank to a use location, said control being connected to said second and third valves to control the operation thereof.

5. A mass balance proportioner for weighing and mixing a concentrated lubricant and a dilution material to form a diluted lubricant having a dilution ratio based upon weight of concentrated lubricant to weight of dilution material as defined in claim 3, further including a mixing tank level sensor connected to said control for sensing the level of said liquid in said mixing tank and effecting said control to close said first valve and deenergize said pump in the event the liquid level in said mixing tank reaches a predetermined maximum level.

6. A mass balance proportioner for weighing and mixing a concentrated lubricant and a dilution material to form a diluted lubricant having a predetermined dilution ratio based upon weight of concentrated lubricant to weight of dilution material as defined in claim 5, further including a second liquid level sensor connected to said control for sensing the liquid level in said storage tank and for effecting said control to close said second valve in the event the liquid level in said storage tank reaches a predetermined maximum level.

7. A mass balance proportioner for weighing and mixing a concentrated lubricant and a dilution material to form a diluted lubricant having a predetermined dilution ratio based upon weight of concentrated lubricant to weight of dilution material as defined in claim 6, further including a third liquid level sensor connected to said controller for sensing the level of liquid in said storage tank and effecting said control to open said second valve from said mixing tank when the liquid level in said storage tank reaches a predetermined minimum level to dump the mixture of diluted lubricant in said mixing tank to said storage tank.

8. A mass balance proportioner for weighing and mixing a concentrated lubricant and a dilution material to form a diluted lubricant having a predetermined dilution ratio based upon weight of concentrated lubricant to weight of dilution material as defined in claim 3, wherein said output signal from said scale includes a first output signal which is indicative of the weight of dilution material in said mixing tank and a second output signal which is indicative of the weight of concentrated lubricant in said mixing tank.

9. Apparatus for mixing a concentrated lubricant and a dilution material by weight comprising a first container, a first inlet for directing a supply of a concentrated lubricant into the first container, a second inlet for directing a supply of a dilution material to the first container, a scale for weighing the dilution material in said first container and for weighing the concentrated lubricant in said first container to create a diluted lubricant in said first container which is based upon a predetermined ratio of weight of concentrated lubricant to weight of dilution material, a first mixer for mixing the concentrated lubricant and the dilution material in said first container to form a substantially homogeneous solution of diluted lubricant, an outlet for directing the substantially homogeneous solution of lubricant from said first container, a second container for receiving from said outlet said substantially homogeneous solution of lubricant from said first container for storing said homogeneous solution of lubricant for use, a second mixer for mixing the substantially homogeneous solution of lubricant in said second container to maintain the solution substantially homogeneous and an outlet from said second container for directing the mixed lubricant and dilution material to a use location.

10. Apparatus for mixing a concentrated lubricant and a dilution material by weight as defined in claim 9, further including a sump located at the use location for collecting excess solution of the diluted lubricant and a return conduit for directing said excess solution of diluted lubricant to said second container for re-mixing and reuse.

11. Apparatus for mixing a concentrated lubricant and a dilution material by weight as defined in claim 9, wherein said scale establishes an output signal indicative of the weight of material in said first container, further including a control for controlling the flow of concentrated lubricant and dilution material to said first container and the predetermined ratio of concentrated lubricant to dilution material by weight, said control receiving said output signal from said scale and sensing the weight of said concentrated lubricant and the weight of said dilution material in said first container, a first valve for controlling the flow of said dilution material to said first container, a pump for pumping concentrated lubricant to said first container, said control being connected to said first valve for controlling the flow of said dilution material to said first container and controlling the energization of said pump to control the flow of concentrated lubricant to said first container in response to said output signal from said scale to form a solution of a concentrated lubricant and a dilution material which is a predetermined ratio based on weight of concentrated lubricant to weight of dilution material.

12. Apparatus for mixing a concentrated lubricant and a dilution material by weight as defined in claim 11, further including a second valve located in said outlet in said first container for controlling the flow of said solution of diluted lubricant from said first container to said second container and a third valve located in said output from said second container for controlling the flow of said solution of diluted lubricant from said second container to a use location.

13. Apparatus for mixing a concentrated lubricant and a dilution material by weight as defined in claim 12, further including a second liquid level sensor connected to said control for sensing the liquid level in said second container and effecting said control to close said second valve in the event the liquid level in said second container reaches a predetermined maximum level.

14. Apparatus for mixing a concentrated lubricant and a dilution material by weight as defined in claim 13, further including a third liquid level sensor connected to said control for sensing the level of liquid in said second container and effecting said control to open said second valve in the event the liquid level in said second container reaches a predetermined minimum level to dump the solution of diluted lubricant in said first container into said second container.

15. Apparatus for mixing a concentrated lubricant and a dilution material by weight as defined in claim 12, further including a third liquid level sensor connected to said control for sensing the level of liquid in said second container and effecting said control to open said second valve in the event the liquid level in said second container reaches a predetermined minimum level to dump the solution of diluted lubricant in said first container into said second container.

16. Apparatus for mixing a concentrated lubricant and dilution material by weight as defined in claim 11, further including a first liquid level sensor connected to said control for sensing the liquid level in said first container and for effecting said control to close said first valve and deenergize said pump in the event the liquid level in said first container reaches a predetermined maximum level.

17. Apparatus for mixing a concentrated lubricant and a dilution material by weight as defined in claim 11, wherein said output signal from said scale includes a first output signal which is indicative of the weight of dilution material in said first container, and a second output signal which is indicative of the weight of concentrated lubricant in said second container.

* * * * *